US005138225A

United States Patent [19]

Kim

[11] Patent Number: 5,138,225

[45] Date of Patent: Aug. 11, 1992

[54] PLASMA DISPLAY DEVICE

[75] Inventor: Dae-il Kim, Kyunggi-do, Rep. of Korea

[73] Assignee: Samsung Electron Devices Co., Ltd., Kyunggi-do, Rep. of Korea

[21] Appl. No.: 705,555

[22] Filed: May 24, 1991

[30] Foreign Application Priority Data

May 25, 1990 [KR] Rep. of Korea ..... 90-7605

[51] Int. Cl.[5] ..... H01J 17/49

[52] U.S. Cl. ..... 313/584; 313/491; 313/492; 313/582; 313/581

[58] Field of Search ..... 313/581, 582, 584, 517, 313/521, 491, 492; 315/169.4

[56] References Cited

U.S. PATENT DOCUMENTS 3,885,195 5/1975 Amano ..... 313/584
4,454,449 6/1984 Hall ..... 313/584
4,737,686 4/1988 Harvey ..... 313/584

*Primary Examiner*—Donald J. Yusko
*Assistant Examiner*—Diab Hamadi
*Attorney, Agent, or Firm*—Leydig, Voit & Mayer

[57] ABSTRACT

A plasma display device comprises two plates defining a gas filled space therebetween, striped anodes and cathodes, wherein the cathodes are composed of a first cathode element and a second cathode element, and a sealing layer. The second cathode is formed on said first cathode element. The sealing layer is formed between the cathodes to prevent the first element from being exposed to the gas filled space. The device forms a high-quality picture by minimizing the difference in luminance between pixels.

4 Claims, 2 Drawing Sheets

PLASMA DISPLAY DEVICE

FIELD OF THE INVENTION

The present invention pertains to a plasma display device, particularly to a plasma display device having cathodes of a low line resistance.

BACKGROUND OF THE INVENTION

Generally, as shown in FIG. 1, plasma display devices are comprised of striped anodes 30 and cathodes 40 arranged in matrix form on the inner surfaces of a face plate 10 and a rear plate 20 respectively, and barrier ribs 50 disposed, to prevent crosstalk, between anodes 30 and bridging the face plate and rear plate. The plasma display devices are constructed such that light of a high luminance is emitted at intersections of the anodes and cathodes or pixels by instantaneously applying high voltage to the anode and cathode exposed to the space filled with discharge gas such as mercury or argon. The plasma display devices range from displays particularly adapted for letters and drawings to larger displays adapted for moving pictures. Such plasma display devices are studied for use in HDTV displays but their design and fabrication are difficult because of the many pixels disposed within the unit area. In particular, anodes and cathodes should be arranged very closely which demand makes the design and material selection for the device very complicated. The selected material for the cathode should be one which can resist bombardment of ions and has low reaction with discharge gas and low resistance. For instance, in a plasma display device using mercury gas, the use of silver paste of high conductivity for forming the cathode produces amalgam. For this reason, nickel paste having low conductivity but high endurance against bombardment of ions and low reaction has been used instead of silver paste. However, in this case, since material resistance is high, in plasma display devices of high resolution requiring very thin and long cathodes, the cathode line resistance increases from one reference point as it becomes farther from that reference point. As a result cathode current is lowered at each pixel or intersection of anode and cathode from the reference point, which widens the difference in luminance between pixels. Particularly, the nickel paste makes the differences wider because the nickel paste has changeable resistance value, depending on the given conditions. As a result, the conventional material cannot be used for cathodes for plasma display devices of high resolution and large size. Thus, the development of a new material and improvement in the construction of the devices are required.

SUMMARY OF THE INVENTION

Therefore, it is an object of the present invention to provide a plasma display device which achieves a high quality picture by minimizing the difference in luminance between pixels.

To accomplish the object, a plasma display device of the present invention comprises a face plate, a rear plate, striped anodes and cathodes arranged in X-Y matrix on the plates, and a gas filled space defined by the face and rear plates, wherein the cathodes are composed of a first cathode element of high conductivity and a second cathode element having sputtering endurance and chemical reaction endurance and overlying the first cathode element, and wherein between the cathodes, sealing layers are formed to prevent exposure of the first cathode element to the gas filled space.

BRIEF DESCRIPTION OF THE DRAWINGS

The above object and other advantages of the present invention will become more apparent by describing in detail the preferred embodiment of the present invention with reference to the attached drawings in which.

DETAILED DESCRIPTION OF THE INVENTION

Figure 1:
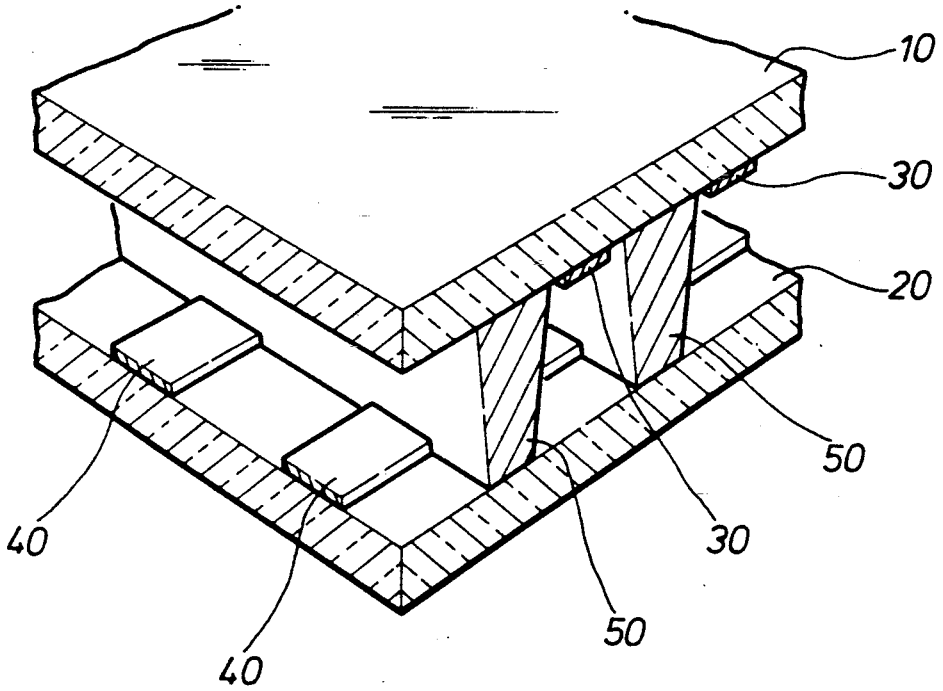
FIG. 1(PRIOR ART)
FIG. 1 is an extracted perspective view of the conventional plasma display device.
Figure 2:
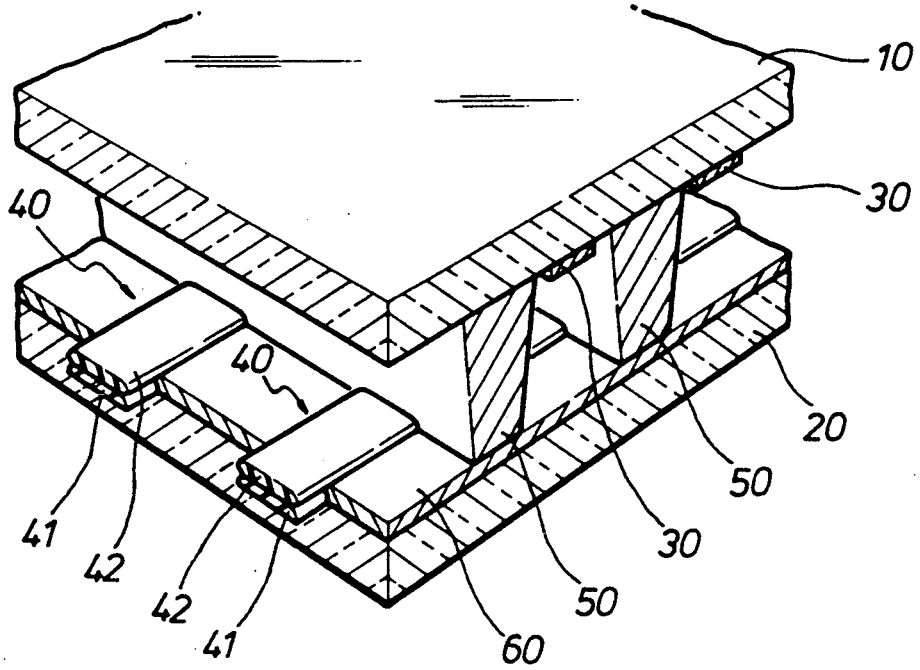
FIG. 2 is an extracted perspective view of a plasma display device according to the present invention.
Figure 3:
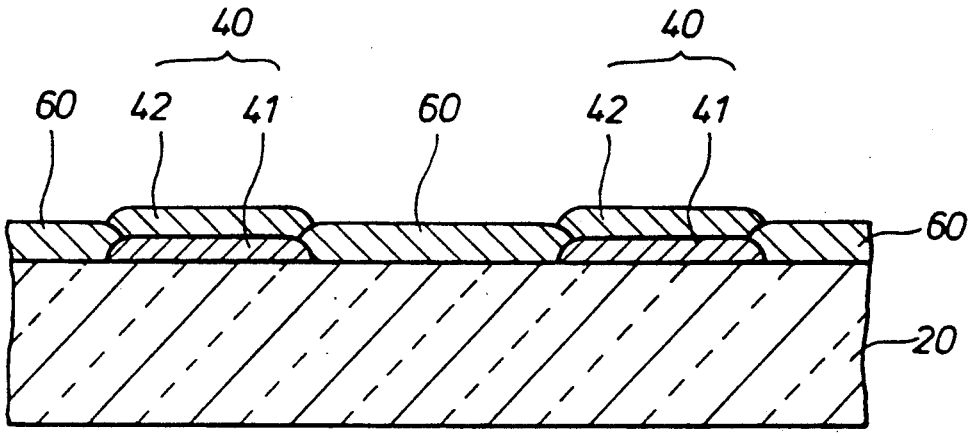
FIG. 3 is an extracted sectional view of the rear plate of the present invention shown in FIG. 2.

Referring to FIG. 2, the plasma display device of the invention, which has generally the same structure as the conventional one, comprises a face plate 10 on which striped transparent anodes 30 are arranged at certain intervals and a rear plate 20 on which cathodes 40 are arranged perpendicularly to the anodes 30. As shown in FIG. 3, the cathodes are composed of a first cathode element 41 formed by silver paste of high conductivity and a second cathode element 42 formed by nickel paste having ion bombardment endurance and reaction endurance. Between and below the cathodes 40, a sealing layer 60 is formed and its ends are overlapped with the ends of the first cathode elements 41. The second cathode element 42 has approximately the same width as that of the first cathode element so that the ends of the second cathode element 42 are also overlapped with the ends of the sealing layer 60. Thus, the first cathode elements 41 are completely isolated from a space filled with gas.

The invention as constructed above is characterized in that the cathodes are composed of a double layer which has improved properties, that is, ion bombardment endurance, reaction endurance and high conductivity. As a bus line, the first cathode elements 41 serve to maintain stable current at each pixel despite the irregular value of resistance of the second cathode elements. Even if the second cathode element positioned on the first cathode element has high resistance and resistance varies in accordance with the fabrication process, especially by the baking process, the second cathode element produces gas discharge of uniform intensity in cooperation with the anode by a sequentially applied voltage because the first cathode element of high conductivity consecutively overlaps with the second element. Furthermore, together with the sealing layer, the second cathode element 42 prevents the first cathode element 41 from being exposed to the discharge gas. Accordingly, the intensities of discharge generated in the respective pixels becomes uniform throughout the whole region of the device so as not to cause deterioration of the picture quality such as spots on the screen by different luminances.

The invention is particularly effective when applied to direct current plasma display devices for moving pictures of high picture quality.

What is claimed is:

1. A plasma display device comprising:

a face plate;

a rear plate spaced apart in parallel from said face plate;

a gas filled space defined by said face and rear plates; and striped anodes and cathodes arranged in X-Y matrix on said face and rear plates respectively, wherein said cathodes are composed of a first cathode element and a second cathode element having ion and reaction endurance, said second cathode element being formed on said first cathode element, and between said cathodes, a sealing layer is formed to prevent sad first cathode element from being exposed to said space filled with gas.

2. A plasma display device as claimed in claim 1, wherein the first cathode elements are made of silver paste.

3. A plasma display device as claimed in claim 1, wherein the second cathode elements are made of nickel paste.

4. A plasma display device comprising:

a face plate;

a rear plate spaced apart in parallel from said face plate;

a gas filled space defined by said face and rear plates;

a plurality of anodes disposed on said face plate;

a plurality of cathodes disposed on said rear plate so that when the plates are joined said anodes and said cathodes form an X-Y matrix, each of said cathodes including a first strip cathode element and a second strip cathode element overlaying the first strip cathode element;

whereby a sequentially applied voltage causes the second cathode element to produce a gas discharge of uniform intensity in cooperation with an anode.

* * * * *

UNITED STATES PATENT AND TRADEMARK OFFICE

CERTIFICATE OF CORRECTION

PATENT NO. : 5,138,225

DATED : August 11, 1992

INVENTOR(S) : Dae-il Kim

It is certified that error appears in the above-identified patent and that said Letters Patent is hereby corrected as shown below:

Claim 1, column 3, line 14, change "sad" to --said--.

Signed and Sealed this

Fourteenth Day of September, 1993

Bruce Lehman

*Attest:*

BRUCE LEHMAN

*Attesting Officer*

*Commissioner of Patents and Trademarks*